US006964349B2

(12) United States Patent
Sears et al.

(10) Patent No.: US 6,964,349 B2
(45) Date of Patent: Nov. 15, 2005

(54) DISPENSER WITH AUTO-START TAB

(75) Inventors: Charles W. Sears, Boxford, MA (US); Elizabeth J. Larson, Neenah, WI (US); Bradley G. Schmidt, Green Bay, WI (US); Edward J. Yock, Appleton, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 10/238,323

(22) Filed: Sep. 10, 2002

(65) Prior Publication Data

US 2003/0062376 A1 Apr. 3, 2003

Related U.S. Application Data

(60) Provisional application No. 60/322,005, filed on Sep. 14, 2001.

(51) Int. Cl.[7] ..... A47K 10/24
(52) U.S. Cl. ..... 221/48; 206/494
(58) Field of Search ..... 221/33, 45, 48, 221/50, 65, 37, 210, 213, 259; 206/494, 812, 559, 460, 409

(56) References Cited

U.S. PATENT DOCUMENTS 3,841,466 A * 10/1974 Hoffman et al. ..... 206/205
4,221,304 A 9/1980 Wahl et al. ..... 221/1
4,574,952 A * 3/1986 Masui ..... 206/494
5,964,351 A * 10/1999 Zander ..... 206/494
6,045,002 A * 4/2000 Wierschke ..... 221/48
6,109,430 A * 8/2000 Bando et al. ..... 206/207
6,202,845 B1 * 3/2001 Hill ..... 206/449
6,550,634 B1 * 4/2003 Alegre De Miquel et al. ... 221/48

* cited by examiner

*Primary Examiner*—Kenneth Noland
(74) *Attorney, Agent, or Firm*—Michael W. Ferrell

(57) ABSTRACT

An auto-start dispensing container for sheet products includes a sealing member secured to a first sheet to be dispensed from the container. In a preferred embodiment, there is provided an auto-start dispenser for dispensing moistened inter-folded wipes which includes: (a) a container provided with a dispensing aperture for receiving a plurality of moist wipes; (b) a removable sealing member affixed to said container to seal the aperture wherein the sealing member and the container form an enclosure adapted to retain moisture; and (c) a lead sheet engaged with the plurality of moist wipes and secured to said removable sealing member, the removable sealing member and the lead sheet being adapted to draw a moist wipe partially through the aperture upon removal of the sealing member from the container. Preferably, the lead sheet is affixed to the removable sealing member by way of a hot-melt adhesive.

40 Claims, 4 Drawing Sheets

DISPENSER WITH AUTO-START TAB

CROSS-REFERENCE TO RELATED APPLICATION

This non-provisional United States patent application is based on Provisional Patent Application Ser. No. 60/322,005, entitled "Moist Wipe Dispenser with Auto-Start Tab", filed Sep. 14, 2001, the priority of which is hereby claimed.

TECHNICAL FIELD

The present invention relates generally to dispensers for wipes, tissue, towel and the like wherein the dispenser container has a removable dispensing aperture cover secured to the first sheet to be dispensed. In a preferred embodiment the invention is directed to a dispenser for moist wipes provided with a removable sealing member secured to a starting sheet inter-folded with a stack of inter-folded wipes to be dispensed.

BACKGROUND

Dispensers for disposable sheet products such as facial tissue, moist wipes and so forth are frequently disposable themselves being made from cardboard or polymer film or are refillable wherein, for example, a thermoformed container is initially provided with the disposable sheet product and refill packages are used to replenish the container. In any event, it is typically difficult to start dispensing disposable sheet product because of its very nature; being relatively thin, it is difficult (for all but those of great manual dexterity) to withdraw a single sheet from the container. For instance, moist wipes are typically distributed in sealed containers which retain their moisture and are often supplied in folded form, in a stack. Since the wipes readily adhere to one another, they are difficult to separate such that more than one wipe is grasped by a consumer. One solution to this problem has been the use of dispensers provided with two lids, an inner, aperture lid and an outer, sealing lid. FIG. 1 is a view in perspective of a currently available dispenser for inter-folded moist wipes of the general class described above.

There is shown in FIG. 1 a prior art dispenser for dispensing inter-folded moist wipes. Prior art dispenser 10 includes a container 12 for receiving a stack of inter-folded moist wipes indicated at 14. The container is provided with an inner lid 16 having an aperture 18. There is further provided an outer lid 20 which does not have an aperture which is used for sealing the enclosure defined by the container. In order to start dispensing the stack, it is necessary for a user to open the inner lid and draw the lead moist wipe through aperture 18 in order to start the stack. Once the stack is started, the container is sealed by way of lid 20 after it is used so as to preserve the moisture of the wipes in the stack. It will be appreciated from the diagram, that it's necessary for the user to start the stack by first opening the inner lid and manually separating at least a portion of the lead sheet from the stack. This is sometimes difficult since moist wipes adhere to each other and are difficult to separate. In any event, once the stack is started a lead sheet such as sheet 22 will draw the subsequent inter-folded sheets through the aperture. As will be appreciated from the foregoing, the start-up of such dispensers can be time consuming and relatively complex, especially when the moist wipe is urgently required.

Perhaps more commonly, difficulty in starting the dispenser or refill pack simply leads to excess waste. A user will attempt to withdraw the first tissue or towel from a stack or roll and instead withdraw many more sheets than intended or needed. The excess sheets are oftentimes discarded without being used at all.

SUMMARY OF THE INVENTION

The present invention is directed to a dispenser where it is not necessary for a user to manually feed the first sheet through an aperture in order to start the dispenser. The invention thus generally relates to dispensers for dispensing wipes, tissues, towels or the like, including a container provided with a dispensing aperture and a plurality of sheets disposed in the container wherein each sheet is adapted to draw a successive sheet partially through the aperture upon removal from the container, wherein the improvement is a movable sealing member secured to a lead sheet configured such that upon movement of the sealing member relative to the container, the lead sheet is withdrawn from the container and a subsequent wipe is partially drawn through the dispensing aperture upon removal of the lead sheet. The invention thus applies to poly pak refills, facial tissue or "pop-up" wipe or tissue dispensers whether the dispensers are simply film, cardboard or foil containers or include a more durable thermoformed container. In one preferred embodiment, there is provided in accordance with the invention an auto-start dispenser for dispensing moistened inter-folded wipes including: (a) a container provided with a dispensing aperture for receiving a stack of inter-folded moist wipes; (b) a removable sealing member affixed to the container to seal the aperture wherein the sealing member and container form an enclosure adapted to retain moisture; and (c) a lead sheet inter-folded with the stack of inter-folded moist wipes and secured to the removable sealing member, the removable sealing member and the lead sheet being adapted to draw an inter-folded moist wipe partially through the aperture upon removal of the sealing member from the container. Most preferably, the lead sheet is secured to the removable sealing member by way of a hot-melt adhesive. Any suitable hot-melt adhesive can be employed. Hot-melt adhesives may include one or more components selected from the group consisting of: poly (ethylene), poly (vinyl acetate), polyamides, bitumens and waxes. Suitable adhesives include Stanley all-purpose hot- melt glue (dual temperature) available from Stanley Fastening Systems, E. Greenwich, R.I. and Arrow all-purpose clear hot-melt glue available from Arrow Fastener Co., Inc., Saddle Brook, N.J. The adhesive may be applied using a Stanley model GR-20 hot-melt glue gun at a medium temperature setting.

The sealing member may be affixed to the container by a variety of methods, including adhesives. The sealing member may be a metal foil or a polymer film. The container may be thermoformed of a plastic material and reusable, or it may be formed from a polymer film or simply be a paper container for dry products. When a thermoformed container is utilized a plastic material such as polystyrene, polyethylene or polypropylene may be used; preferably a recyclable plastic. When a polymer film is used as the container, biaxially oriented films are preferred because of their barrier properties. Typically such films may be polyethylene terephthalate films or polypropylene films. The moist wipes may be made of a variety of cellulosic materials such as paper materials, or cloth materials and are made in some preferred embodiments from an air-laid web.

The moist wipes are moistened with a moistening composition including water and a variety of other ingredients. In some embodiments such ingredients would include an emollient such as aloe vera gel, or lanolin. In still other embodiments the moistening composition may include as an active ingredient benzalkonium chloride. Typically other ingredients such as propylene glycol, citric acid, tocopherol (vitamin E), tocopherol derivatives, fragrance and the like may be added to the moistening composition if so desired.

In another aspect of the invention there is provided the improvement to a dispenser adapted to dispense moist wipes. In particular there is provided in a dispenser for dispensing moist wipes including a container provided with a dispensing aperture and a plurality of moist wipes disposed in the container, wherein each moist wipe is adapted to draw a successive wipe partially through the aperture upon removal from the container, the improvement including a removable sealing member affixed to said container wherein the removable sealing member and the container define a moisture retaining enclosure and the removable sealing member is secured to a lead sheet configured such that upon removal of the sealing member the lead sheet is withdrawn from the container and a subsequent wipe is partially drawn through the dispensing aperture.

The present invention may include a container with a removable tab as illustrated below, or a lead sheet may be directly affixed to the lid of a container as will be appreciated by one of skill in the art. In such cases a lead sheet may be affixed directly to a flip lid, for example, and the exterior of the package could be sealed with film or foil. While the present invention is perhaps most advantageously employed in connection with wipes, it may find application in connection with dry absorbent sheet, for example, tissue or towel products. Such products may be in a stack having the various fold geometries illustrated in the appended drawings or in the form of a perforated roll. Still further features and advantages of the present invention will become apparent upon consideration of the following description and drawings.

BRIEF DESCRIPTION OF DRAWINGS

The invention is described in detail below in connection with the various figures in which.

DETAILED DESCRIPTION

The invention is described in detail below with reference to several embodiments. Such description is for purposes of illustration only and is in no way limitative of the invention.

Moist wipes are known in the art and are distributed in a variety of ways. Some are distributed as folded, sometimes inter-folded wipes, while others are dispensed via roll form in cylindrical containers. Due to their convenience, such wipes have gained wide spread commercial acceptance.

Typically wipes may be made from cloth or paper materials, such as an air-laid web moistened with water and optionally additional ingredients. A preferred active ingredient in some products is benzalkonium chloride, a cleaning and antiseptic agent. Other ingredients include: emollients such as aloe vera gel, lanolin and naturally occurring oils and their derivatives. Further included may be dispersing agents, fragrance, other anti-septic agents, emulsifiers and so forth. Typical ingredients include propylene glycol, citric acid, tocopherol (Vitamin E) and its derivative esters, disodium cocoamphodiacetate, isothiazolinones, disodium EDTA (ethylenediaminetetraacetic acid disodium salt) and so forth.

Figure 1:
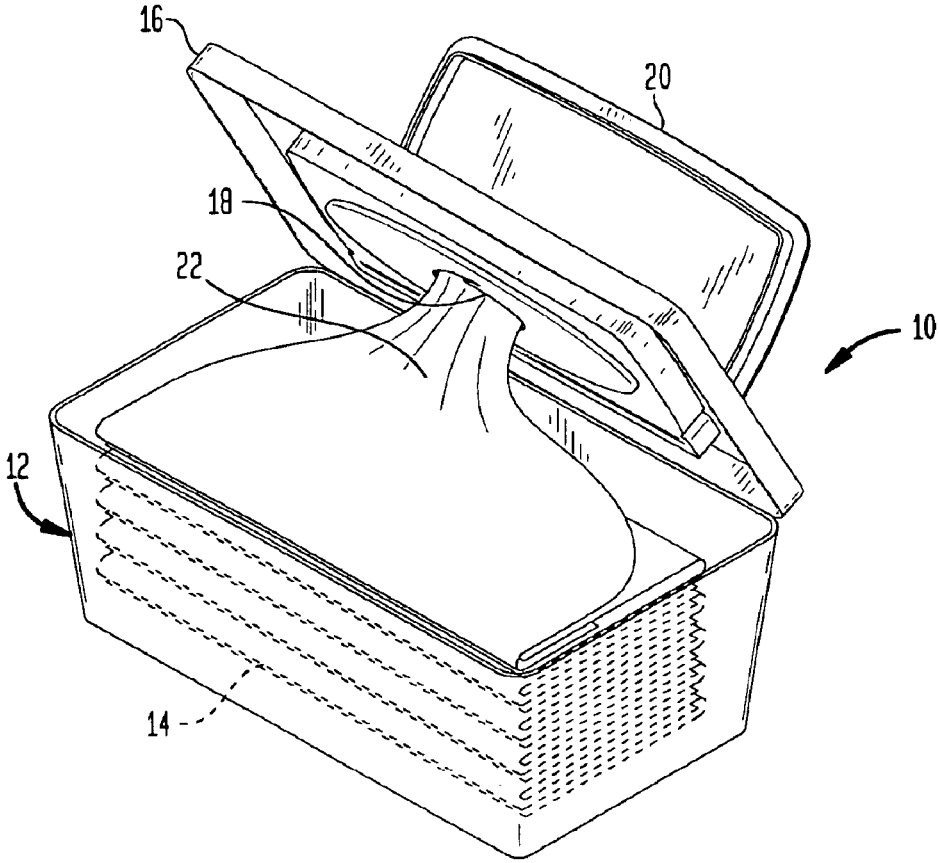
FIG. 1 (PRIOR ART)
FIG. 1 is a view in perspective showing a prior art dispenser for inter-folded moist wipes.
Figure 2:
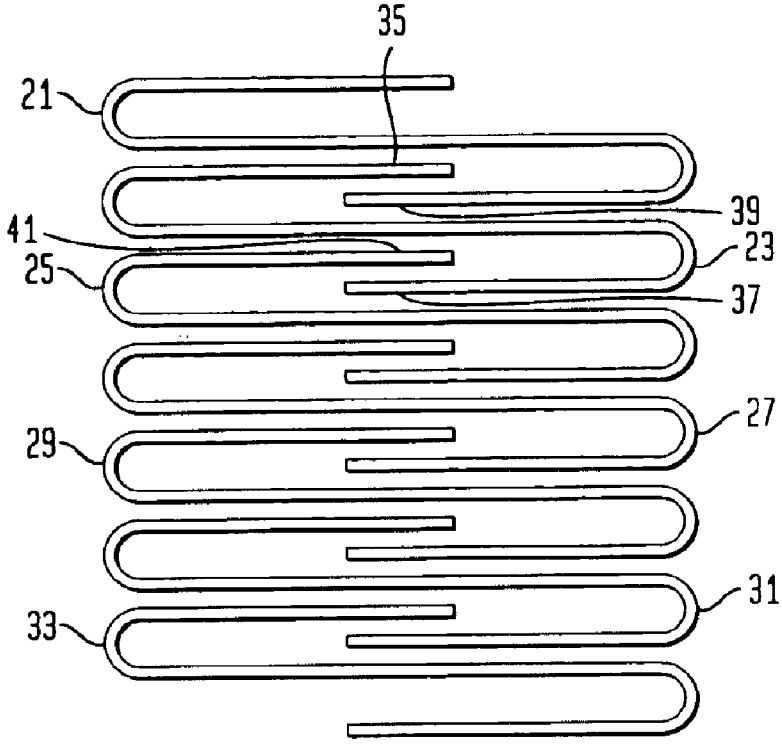
FIG. 2 is a schematic diagram illustrating fold geometry for a stack of Z-fold inter-folded moist wipes.

Likewise, inter-folded wipes may be inter-folded in a variety of fold geometries. There is shown in FIG. 2 what is termed a Z-fold geometry. This terminology is used because a plurality of moist wipes such as moist wipes 21 through 33 are arranged in a stack with Z-folds defining a Z shape provided with interfolded panels. Thus moist wipe 23 has an upper panel 35 and a lower panel 37 as shown. Panel 35 is inter-folded with panel 39 of moist wipe 21, whereas panel 37 overlaps with panel 41 of moist wipe 25.

Figure 3:
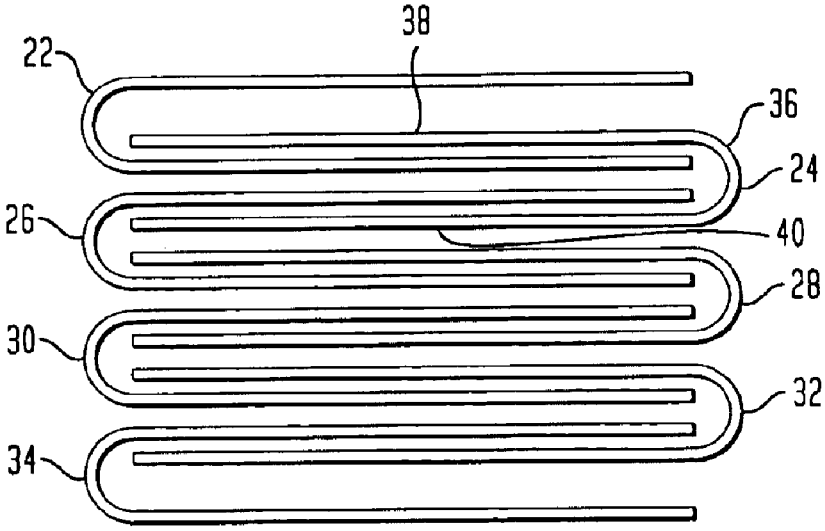
FIG. 3 is a schematic diagram illustrating fold geometry for a stack of V-fold inter-folded moist wipes.

There is shown in FIG. 3 what is termed a V-fold inter-fold geometry for a stack of moist wipes. This terminology is used because a plurality of moist wipes such as moist wipes 22 through 34 are arranged in a stack with a single fold such as fold 36 of wipe 24 about one edge thereof. Each wipe thus has first and second panels such as panels 38 and 40 inter-folded with adjacent moist wipes.

Figure 4:
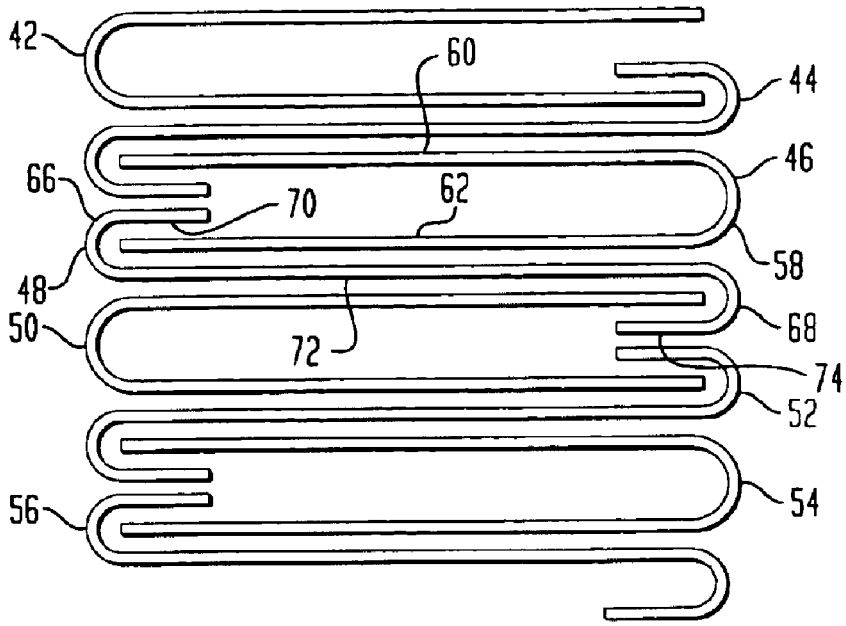
FIG. 4 is a schematic diagram showing fold geometry for a stack of VZ-fold inter-folded moist wipes.

Another suitable fold geometry is seen in FIG. 4 hereof. This fold geometry is called a VZ-fold inter-folded geometry. Here a plurality of moist wipes such as wipes 42 through 56 are arranged in a stack such that alternating napkins have single folds and double folds respectively as can be seen by comparing moist wipe 46 with moist wipe 48. Moist wipe 46 has a single fold 58 separating its two panels 60 and 62 whereas moist wipe 48 has two folds 66, 68 separating its three panels 70, 72, and 74 respectively.

Figure 5:
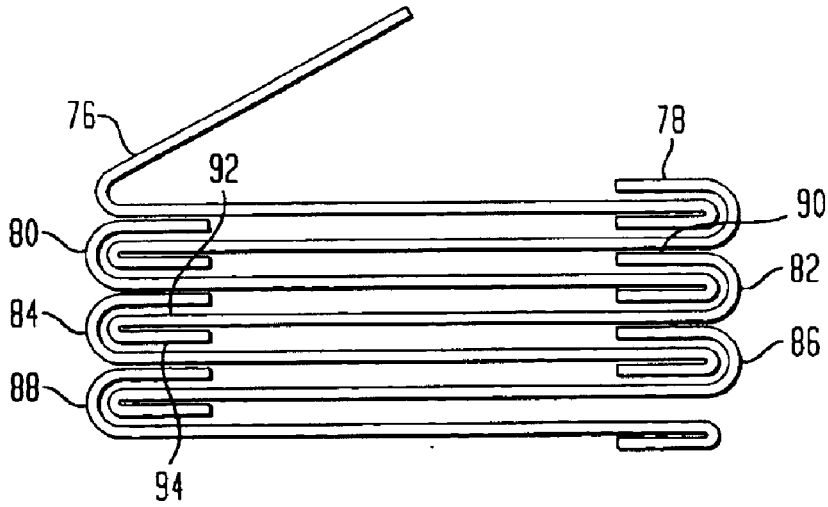
FIG. 5 is a schematic diagram showing fold geometry for a stack of modified Z-fold inter-folded moist wipes.

Still yet another geometry for an inter-folded stack of moist wipes is shown in FIG. 5. Here there is shown a plurality of moist wipes 76–88 each of which is provided with two folds. Thus, such geometry is termed a modified Z-fold inter-folded geometry for the moist wipes. As will be appreciated from FIG. 5, a moist wipe such as moist wipe 82 is inter-folded by way of its panel 90 with moist wipe 80 and by way of its panels 92, 94 with moist wipe 84. Any suitable inter-folded geometry may be employed in accordance with the various embodiments to the invention, or one may employ a roll of perforated moist wipes (where the wipes are releasably engaged to each other) with the improved auto-start feature of the invention.

Figure 6:
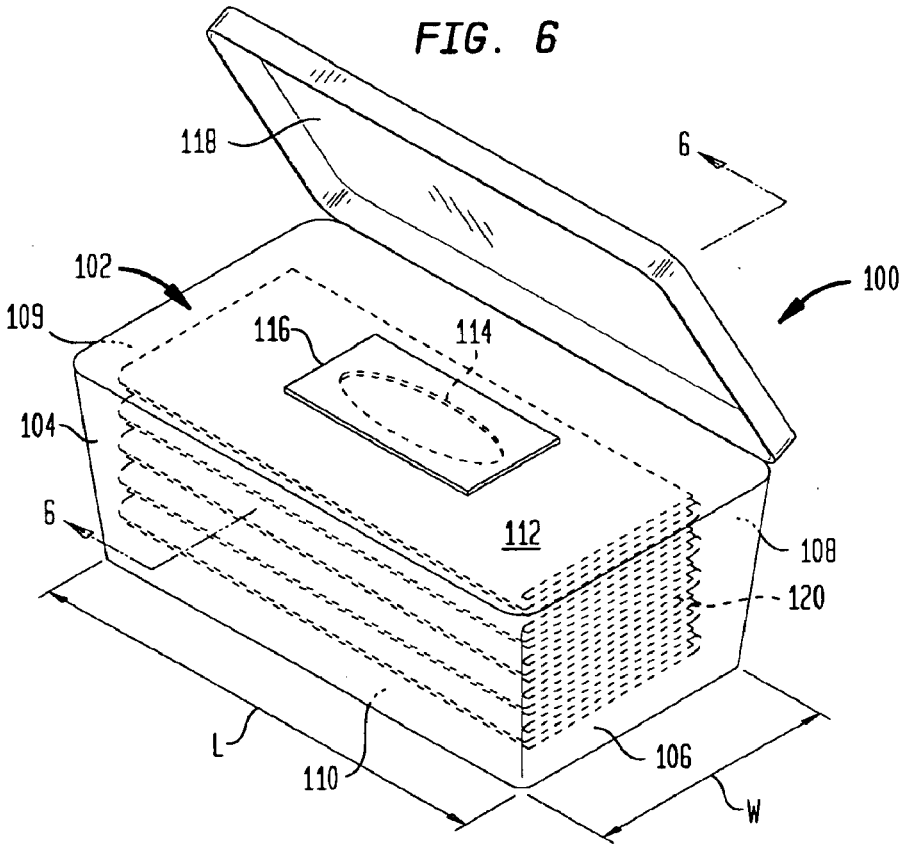
FIG. 6 is a view in perspective of a dispenser configured in accordance with the present invention.
Figure 7:
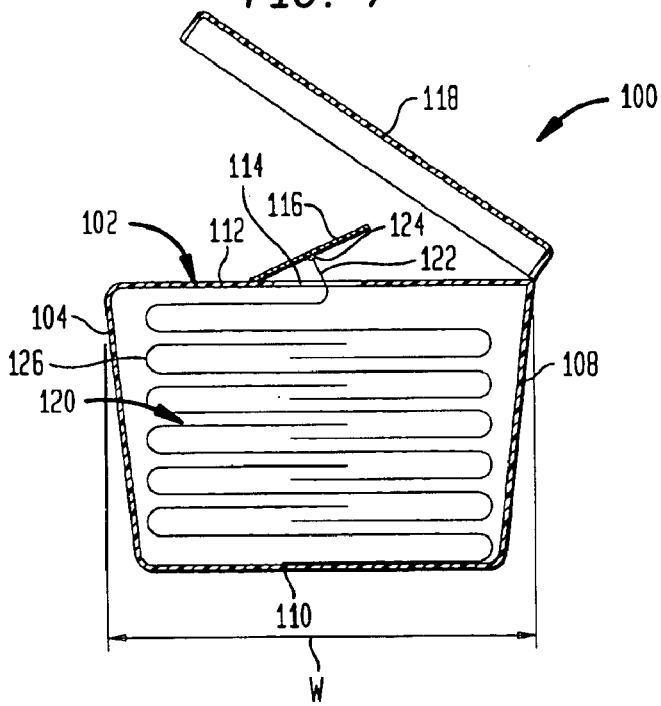
FIG. 7 is an enlarged view in elevation and section illustrating operation of the auto-start feature of the present invention.

One way of practicing the present invention will be appreciated by considering FIG. 6 and FIG. 7. FIG. 6 is a view in perspective of an auto-start dispenser configured in accordance with the present invention whereas FIG. 7 is an enlarged view in section and elevation along line 6—6 showing the auto-start feature.

There is shown in FIGS. 6 and 7 a dispenser 100 including a container 102 provided with sidewalls 104, 106, 108 and 109, a bottom 110 and a top wall 112. Dispenser 100 has a length, L, and width, W. Top wall 112 is provided with a dispensing aperture 114 through which the inter-folded moist wipes are to be withdrawn. In order to retain the moisture there is provided a removable sealing member 116 which may foil or polymer film as noted above which is placed about aperture 114 and secured to top 112 in order to hermetically seal the cavity into which a stack of inter-folded moist wipes 120 are placed. There is typically provided a lid 118 which is used to seal the container after the sealing member 116 is removed to expose the product.

In FIG. 7 there is shown the inventive moist wipe dispenser 100 wherein the removable sealing member 116 is being peeled from wall 112 to open aperture 114. A lead sheet 122 is provided in an inter-folded stack 120 of moist wipes and affixed to removable sealing member 116 with hot-melt adhesive 124. Thus when a user removes tab 116 lead sheet 122 is withdrawn from the tab and by virtue of its inter-folded cohesion with the following or first sheet 126 of the stack of moist wipes the moist wipe dispenser is provided with a "auto-start" feature. While in the embodiments of FIGS. 6 and 7 the inventive dispenser 100 is shown in connection with Z-fold inter-folded moist wipes; however the geometry would be quite similar when utilizing other fold geometries for the moist wipes. The key feature of the inter-folded product is that the subsequent sheet will follow the previous sheet since they are in intimate contact and releasably engaged to one another either mechanically or by cohesive forces, as one of skill in the art will appreciate. Likewise the inventive dispenser may be utilized in connection with moist wipes which are provided in roll form with perforations between sheets.

While the invention has been described in detail with reference to several embodiments, modifications within the spirit and scope of the present invention, set forth in the appended claims, will be readily apparent to one of skill in the art.

What is claimed is:

1. An auto-start dispenser for dispensing moistened inter-folded wipes comprising:

(a) a container provided with a dispensing aperture having disposed therein a stack of inter-folded moist wipes;

(b) a removable sealing member affixed to said container to seal said aperture wherein the sealing member and the container form an enclosure adapted to retain moisture; and (c) a lead sheer inter-folded with said stack of inter-folded moist wipes and secured to said removable sealing member, said removable sealing member and said lead sheet being adapted to draw an inter-folded moist wipe partially through said aperture upon removal of said sealing member from said container, wherein said lead sheet is secured to said removable sealing member by way of a hot-melt adhesive.

2. The improvement according to claim 1, wherein said stack has a Z-fold geometry.

3. The improvement according to claim 1, wherein said stack has a V-fold geometry.

4. The improvement according to claim 1, wherein said stack has a VZ-fold geometry.

5. The improvement according to claim 1, wherein said stack has a modified Z-fold geometry.

6. The improvement according to claim 1, wherein said hot-melt adhesive comprises one or more components selected from the group consisting of: poly(ethylene); poly (vinyl acetate), polyamides, bitumens and waxes.

7. The auto-start dispenser according to claim 1, wherein said hot-melt adhesive comprises one or more components selected from the group consisting of: poly(ethylene), poly (vinyl acetate), polyamides, bitumens, and waxes.

8. The auto-start dispenser according to claim 1, wherein said removable sealing member is adhesively affixed to said container.

9. The auto-start dispenser according to claim 1, wherein said removable sealing member is formed from a metal foil.

10. The auto-start dispenser according to claim 1, wherein said removable sealing member is formed from a polymer film.

11. The auto-start dispenser according to claim 1, wherein said container is thermoformed from a plastic material.

12. The auto-start dispenser according to claim 11, wherein said plastic is selected from the group consisting of: polystyrene, polyethylene, and polypropylene.

13. The auto-start dispenser according to claim 1, wherein said container is formed from a polymer film.

14. The auto-start dispenser according to claim 13, wherein said polymer film is a biaxially oriented polymer film.

15. The auto-start dispenser according to claim 14, wherein said biaxially oriented polymer film is a biaxially oriented poly (ethylene terephthalate) biaxially oriented film or a polypropylene biaxially oriented film.

16. The auto-start dispenser according to claim 1, wherein said inter-folded moist wipes are made from an air-laid web substrate.

17. The auto-start dispenser according to claim 1, wherein said moist wipes are moistened with a moistening composition including an emollient.

18. The auto-start dispenser according to claim 17, wherein said emollient is selected from the group consisting of: aloe vera gel, lanolin and mixtures thereof.

19. The auto-start dispenser according to claim 1, wherein said moist wipes are moistened with a moistening composition including benzalkonium chloride as an active ingredient.

20. The auto-start dispenser according to claim 1, wherein said moist wipes are moistened with a composition including one or more ingredients selected from the group consisting of: propylene glycol, citric acid, tocopherol, and tocopherol derivatives.

21. The auto-start dispenser according to claim 1, wherein said stack of inter-folded moist wipes is a stack of single fold inter-folded moist wipes.

22. The auto-start dispenser according to claim 1, wherein said stack of inter-folded moist wipes are a stack of inter-folded double fold moist wipes.

23. The auto-start dispenser according to claim 1, wherein said stack of inter-folded moist wipes are a stack of inter-folded alternating single fold/double fold inter-folded moist wipes.

24. In a dispenser for dispensing moist wipes including a container provided with a dispensing aperture and a plurality of moist wipes disposed in said container wherein each moist wipe is adapted to draw a successive wipe partially through the aperture upon removal from the container, the improvement comprising a removable sealing member affixed to said container wherein said removable sealing member and said container define a moisture-retaining enclosure and said removable sealing member is secured to a lead sheet configured such that upon removal of said sealing member, said lead sheet is withdrawn from said container and a subsequent wipe is partially drawn through said dispensing aperture upon removal of said lead sheet wherein the lead sheet is secured to the removable sealing member by way of a hot-melt adhesive.

25. The improvement according to claim 24, wherein said hot-melt adhesive comprises one or more components selected from the group consisting of: poly(ethylene), poly (vinyl acetate), polyamides, bitumens and waxes.

26. The improvement according to claim 24, wherein the removable sealing member is adhesively affixed to container.

27. The improvement according to claim 24, wherein the sealing member is formed from a metal foil.

28. The improvement according to claim 24, wherein the sealing member is formed from a polymer film.

29. The improvement according to claim 24, wherein said moist wipes are made from an air-laid web.

30. The improvement according to claim 24, wherein said moist wipes are moistened with a moistening composition including an emollient.

31. The improvement according to claim 30, wherein said emollient is selected from the group consisting of aloe vera gel and lanolin.

32. The improvement according to claim 24, wherein said moist wipes are moistened with a moistening composition including benzalkonium chloride as an active ingredient.

33. The improvement according to claim 24, wherein said moist wipes are moistened with a composition including an ingredient selected from the group consisting of polypropylene glycol, citric acid, tocopherol, and tocopherol derivatives.

34. In a dispenser for dispensing moist wipes including a container provided with a dispensing aperture and a plurality of moist wipes disposed in said container wherein each moist wipe is adapted to draw a successive wipe partially through the aperture upon removal thereof from the container, the improvement comprising a movable member secured to a lead sheet configured such that upon movement of said movable member relative to said container, said lead sheet is withdrawn from said container and a subsequent wipe is partially drawn through said dispensing aperture upon removal of said lead sheet, wherein the lead sheet is secured to the movable member by way of a hot-melt adhesive.

35. The improvement according to claim 34, wherein said hot-melt adhesive comprises one or more components selected from the group consisting of: poly(ethylene), poly (vinyl acetate), polyamides, bitumens and waxes.

36. The improvement according to claim 34, wherein said moist wipes are moistened with a moistening composition including an emollient.

37. The improvement according to claim 36, wherein said emollient is selected from the group consisting of aloe vera gel and lanolin.

38. The improvement according to claim 34, wherein said moist wipes are moistened with a moistening composition including benzalkonium chloride as an active ingredient.

39. The improvement according to claim 34, wherein said moist wipes are moistened with a composition including an ingredient selected from the group consisting of polypropylene glycol, citric acid, tocopherol, and tocopherol derivatives.

40. An auto-start dispenser for dispensing moistened inter-folded wipes comprising:

(a) a container provided with a dispensing aperture as well as a resealable lid having disposed therein a stack of inter-folded moist wipes;

(b) a removable sealing member affixed to said container to seal said aperture wherein the sealing member and the container form an enclosure adapted to retain moisture; and (c) a lead sheet inter-folded with said stack of inter-folded moist wipes and secured to said removable sealing member, said removable sealing member and said lead sheet being adapted to draw an inter-folded moist wipe partially through said aperture upon removal of said sealing member from said container, wherein said lead sheet is secured to maid removable sealing member by way of a hot-melt adhesive.

* * * * *

UNITED STATES PATENT AND TRADEMARK OFFICE

CERTIFICATE OF CORRECTION

PATENT NO. : 6,964,349 B2
APPLICATION NO. : 10/238323
DATED : November 15, 2005
INVENTOR(S) : Charles W. Sears et al.

It is certified that error appears in the above-identified patent and that said Letters Patent is hereby corrected as shown below:

At Col. 4, lines 64, insert --be-- before “foil”;
At Col. 5, line 12, delete “a” and insert --an--;
At Col. 5, line 12, delete “While”;
At Col. 5, line 12, delete “in” and insert --In--;
At Col. 5, line 39, delete “sheer” and insert --sheet-;
At Col. 5, line 57, delete “;” and insert --,--; and
At Col. 8, line 32, delete “maid” and insert --said--.

Signed and Sealed this

Twenty-second Day of August, 2006

JON W. DUDAS
*Director of the United States Patent and Trademark Office*